US010337344B2

(12) United States Patent
Granberg et al.

(10) Patent No.: US 10,337,344 B2
(45) Date of Patent: Jul. 2, 2019

(54) TURBOMACHINE WITH AN INGESTION SHIELD AND USE OF THE TURBOMACHINE

(71) Applicant: Siemens Aktiengesellschaft, Munich (DE)

(72) Inventors: Per Granberg, Norsholm (SE); Janos Szijarto, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 310 days.

(21) Appl. No.: 15/312,911

(22) PCT Filed: May 8, 2015

(86) PCT No.: PCT/EP2015/060187

§ 371 (c)(1),
(2) Date: Nov. 21, 2016

(87) PCT Pub. No.: WO2015/180946

PCT Pub. Date: Dec. 3, 2015

(65) Prior Publication Data

US 2017/0159468 A1 Jun. 8, 2017

(30) Foreign Application Priority Data

May 27, 2014 (EP) ..... 14170011

(51) Int. Cl.
*F01D 11/00* (2006.01)
*F01D 9/04* (2006.01)
(Continued)

(52) U.S. Cl.
CPC ..... *F01D 11/001* (2013.01); *F01D 5/08* (2013.01); *F01D 9/04* (2013.01); *F01D 9/042* (2013.01);
(Continued)

(58) Field of Classification Search
CPC .. F01D 11/001; F05D 25/007; F05D 2240/15; F05D 2300/171
(Continued)

(56) References Cited

U.S. PATENT DOCUMENTS 3,356,340 A * 12/1967 Bobo ..... F01D 5/081 415/115
3,647,311 A 3/1972 Wootton et al.
(Continued)

FOREIGN PATENT DOCUMENTS

CN 101845997 A 9/2010
EP 0770761 A1 5/1997
(Continued)

OTHER PUBLICATIONS

CN Office Action dated Jun. 19, 2017, for CN patent application No. 201580027284.6.
(Continued)

*Primary Examiner* — Mahmoud Gimie
(74) *Attorney, Agent, or Firm* — Beusse Wolter Sanks & Maire

(57) ABSTRACT

A turbomachine, for instance a gas turbine or a steam turbine, has a stator with at least one stator component, a rotor with at least one rotor component, at least one working fluid channel for channeling a working fluid for driving the rotor, wherein the working fluid channel is bordered by the stator component and the rotor component, and a cavity located downstream of the stator component and upstream of the rotor component in respect of the flow of the working fluid in the working fluid channel. At least one heat shield is located in the cavity separating the cavity into a first cavity and a second cavity for reducing the working fluid ingress
(Continued)

into the second cavity for protecting the stator component and/or the rotor component from an erosive attack of the working fluid.

16 Claims, 2 Drawing Sheets

(51) Int. Cl.
*F01D 5/08* (2006.01)
*F01D 25/00* (2006.01)

(52) U.S. Cl.
CPC ..... *F01D 25/007* (2013.01); *F05D 2240/15* (2013.01); *F05D 2300/171* (2013.01)

(58) Field of Classification Search
USPC ..... 415/173.7, 174.4
See application file for complete search history.

(56) References Cited

U.S. PATENT DOCUMENTS 5,429,478 A * 7/1995 Krizan ..... F01D 11/001 415/115
6,302,642 B1 * 10/2001 Nagler ..... F01D 11/24 415/116
2005/0118016 A1 6/2005 Fokine et al.
2005/0163608 A1 7/2005 Okita et al.
2010/0047062 A1 * 2/2010 Khanin ..... F01D 11/08 415/175
2010/0232939 A1 * 9/2010 Piersall ..... F01D 5/082 415/173.1
2010/0239413 A1 9/2010 Tesh et al.
2011/0110771 A1 * 5/2011 Morgan ..... F01D 5/147 415/177
2015/0330241 A1 * 11/2015 Chuong ..... F01D 11/001 415/173.1
2015/0330244 A1 * 11/2015 Vo ..... F01D 9/065 415/173.5

FOREIGN PATENT DOCUMENTS

EP 2236768 A2 10/2010
EP 2634373 A1 9/2013
JP S4826089 B1 8/1973

OTHER PUBLICATIONS

EP Search Report dated Nov. 19, 2014, for EP patent application No. 14170011.2.
International Search Report dated Sep. 11, 2015, for PCT application No. PCT/EP2015/060187 (previously submitted).
IPER (PCT/IPEA 409 and 416) dated Jul. 29, 2016, for PCT application No. PCT/EP2015/060187 (previously submitted).

* cited by examiner

TURBOMACHINE WITH AN INGESTION SHIELD AND USE OF THE TURBOMACHINE

CROSS REFERENCE TO RELATED APPLICATIONS

This application is the US National Stage of International Application No. PCT/EP2015/060187 filed May 8, 2015, and claims the benefit thereof. The International application claims the benefit of European Application No. EP14170011 filed May 27, 2014. All of the applications are incorporated by reference herein in their entirety.

FIELD OF THE INVENTION

The present invention refers to a turbomachine with an ingestion heat shield and a use of the turbomachine.

BACKGROUND OF THE INVENTION

A turbomachine, for instance a gas turbine or a steam turbine, is used for power generation. Such a turbomachine comprises a stator with at least one stator component and a rotor with at least one rotor component.

Rotor components of the rotor are an axial shaft and a plurality of rotor blades. The rotor blades are arranged annularly around the axial shaft.

Stator components are a stator ring and a plurality of guide vanes for guiding working fluid of the turbomachine (hot gas in case of a gas turbine and superheated steam in case of a steam turbine). The stator ring and the rotor shaft are coaxially arranged to each other. The guide vanes are arranged annularly around the stator ring.

The guide vanes assist in guiding the working fluid for the impingement of the working fluid on the rotor blades of the rotor.

The working fluid is lead through a working fluid channel of the turbomachine. The working fluid channel is bordered by at least one of the stator components and by at least one of the rotor components. Due to very high temperatures of the working fluid the bordering stator component and/or the bordering rotor component are highly stressed.

EP 2 634 373 A1 shows an embodiment in which one heat shield is present to protect an upstream end of a platform of a vane.

SUMMARY OF THE INVENTION

It is an object of the invention to provide a turbomachine with a working fluid channel for leading the working fluid to blades of the rotor. The turbomachine should be robust such that a degradation of the stator component doesn't take place while leading hot working fluid through the working fluid channel, particularly in cavities between rotor and stator components.

A further object of the invention is the use of the turbomachine.

These objects are achieved by the invention specified in the claims.

A turbomachine is provided which comprises a stator with at least one stator component, a rotor with at least one rotor component and at least one working fluid channel for channeling a working fluid for driving the rotor, wherein the working fluid channel is bordered by the stator component and the rotor component. The turbomachine is characterized in that at least one heat shield is located in the working fluid channel for protecting the stator component from an erosive attack of the working fluid.

In more detail, the turbomachine comprises a stator with at least one stator component, a rotor with at least one rotor component, at least one working fluid channel for channeling a working fluid for driving the rotor, wherein the working fluid channel is bordered by the stator component and the rotor component, and a cavity located downstream of the stator component and upstream of the rotor component in respect of the flow of the working fluid in the working fluid channel. Furthermore the turbomachine comprises at least one heat shield that is located in the cavity separating the cavity into a first cavity and a second cavity for reducing the working fluid ingress into the second cavity for protecting the stator component and/or the rotor component from an erosive attack of the working fluid.

As said, the turbomachine comprises a cavity located downstream of the stator component and upstream of the rotor component. The upstream and downstream directions are defined in respect of the flow of the working fluid in the working fluid channel.

This turbomachine is used for producing electricity by leading the working fluid to rotor blades of the rotor through the working fluid channel. For that, the rotor is coupled to at least one generator.

The working fluid channel is a channel for impingement of the working fluid on rotor blades of the rotor. The heat shield is an ingestion shield to reduce or block ingestion into a hollow space between a rotor and a stator.

The cavity and the heat shield act as a seal between a stator and a rotor to block inflow of hot working fluid into a hollow space between the stator and the rotor.

The heat shield supports the sealing effect, if it is formed such that it comprises a conical section. The orientation of the conical section supports that the hot working fluid is reflected into the first cavity and that the hot working fluid does not pass by the heat shield and into the second cavity.

The heat shield and the rotor will not be in contact. Thus, the seal will be contactless. This allows adaption of all components to the temperatures during operation.

The heat shield may be produced by a sheet metal.

Advantageously the sheet metal is formed so that the heat shield comprises a circular ring section, a cylindrical section and a conical section.

The circular ring section may be clamped between two stator parts. The cylindrical section may be partly in contact with a stator part. The conical section may not have direct physical contact with a stator or rotor component. The conical section may simply by a dividing plate within the cavity dividing the cavity into the first and the second cavity.

The heat shield is a separate component and not monolithic with other stator parts. This allows easy replacement of the heat shield during maintenance.

The heat shield protects a cavity downstream of the stator from ingress of the hot working fluid into the cavity.

The working fluid is hot gas of a gas turbine or superheated steam of a steam turbine. The hot gas of the gas turbine comprises exhaust gases of a burning process (oxidation of a fuel). A temperature of the hot gas reaches temperatures of more than 1000° C.

Concerning another embodiment the heat shield comprises at least one consumable. The consumable is cheap and easily available. Advantageously the heat shield is a consumable, i.e. is completely made of consumable material.

Advantageously the consumable comprises a metal alloy. Advantageously, the metal alloy is a low grade alloy such as stainless steel. Stainless steel is easily available and relatively cheap.

With "consumable" it is meant that the material is of lower grade than the stator and/or the rotor. I.e. the heat shield can be produced cheaper than the stator and/or the rotor.

According to another embodiment the heat shield comprises a thickness which is selected from the range between 0.5 mm and 5.0 mm, advantageously selected from the range between 1.0 mm and 3.0 mm and more advantageously selected from the range between 1.5 mm and 2.5 mm. For instance, the thickness is about 2.0 mm. Such thicknesses are enough in order to fulfill the function as heat shield for a longer period. The heat shield can be exchanged during routinely maintenance work.

The stator component which borders the working fluid channel can be any part of the stator. Advantageously, the stator component is a stator ring of the stator. The stator ring borders the working fluid channel and is protected by the heat shield so that working fluid can't easily attack the stator ring.

The heat shield is advantageously directly assembled to the stator component. Stator component and heat shield are directly connected to each other. For instance, the heat shield is welded to the stator ring.

Concerning another embodiment, the heat shield is mechanically fixed between the stator ring and a guide vane of the turbomachine. The heat shield is located between the guide vane and the stator ring and is fixed only geometrically by a clamping mechanism. The heat shield is clamped between the stator ring and the guide vane. By this, an accommodation of different thermal expansions of the different components is reached.

Advantageously, the heat shield is located at a downstream end of the stator in respect of the flow direction of the working fluid in the working fluid channel.

Concerning another embodiment, the heat shield comprises a heat shield ring. The heat shield is an annular heat shield. This heat shield can be one piece which is not subdivided. Alternatively, the annular heat shield is subdivided. In another embodiment, the heat shield ring is a segmented ring or a split ring. By the segmentation of the ring or the split of the ring an additional degree of freedom is reached. This is advantageous in order to reduce thermal stress of the complete assembly.

BRIEF DESCRIPTION OF THE DRAWINGS

Further features and advantages of the invention are produced from the description of exemplary embodiment with reference to the drawings. The drawings are schematic.

DETAILED DESCRIPTION OF THE INVENTION

Figure 1:
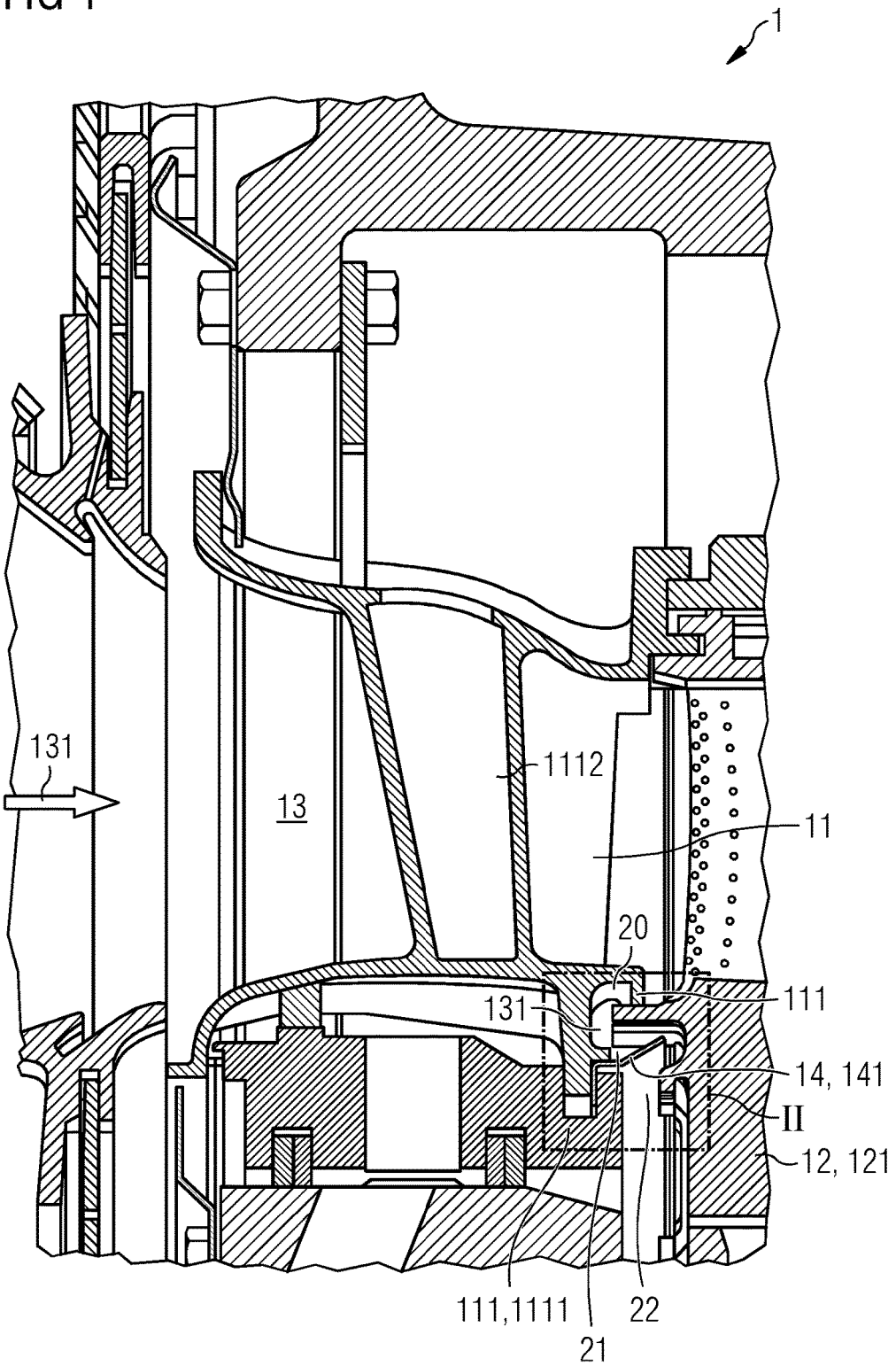
FIG. 1 shows a cross section of a turbomachine.
Figure 2:
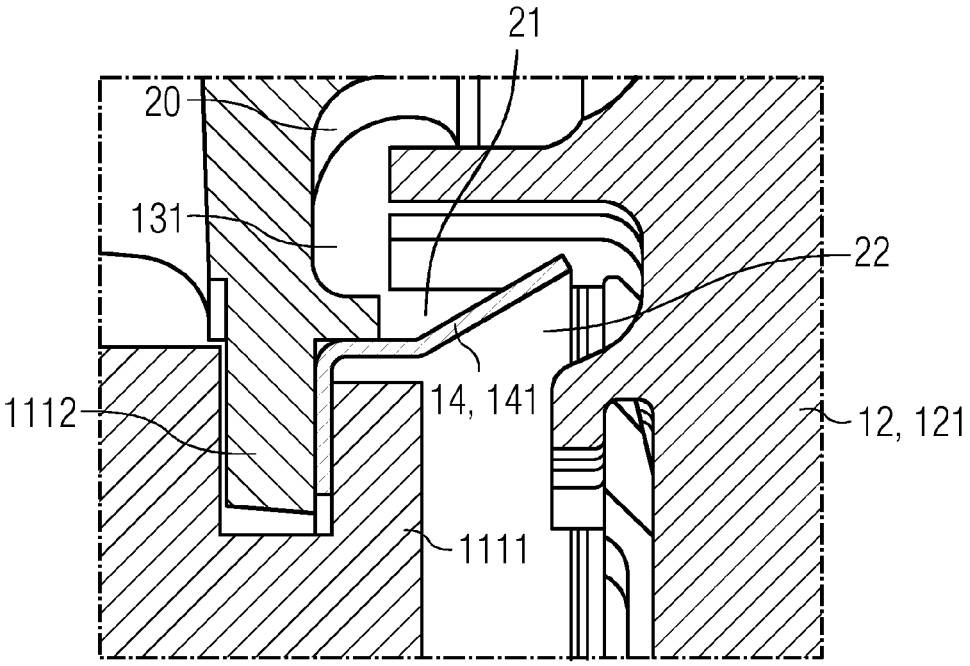
FIG. 2 shows a detail of FIG. 1.

Given is a turbomachine 1. The turbomachine is a gas turbine. The turbomachine 1 comprises a stator 11 with at least one stator component 111. The stator component is an annular stator ring 1111.

The turbomachine comprises additionally a rotor 12 with at least one rotor component 121. The rotor component 121 comprises an axial rotor shaft on which rotor blades are arranged for driving the rotor shaft. The rotor shaft and the stator ring are coaxially arranged to each other.

At least one working fluid channel 13 for channeling working fluid 131 (hot exhaust gas of a combustion process) to the rotor blades is arranged between the stator ring 1111 and the rotor shaft. Through the working fluid channel 13 working fluid 131 can be led to the rotor blades for driving the rotor 12. The working fluid channel 13 is bordered by the stator component 111 (stator ring 1111) and the rotor component 121 (rotor shaft).

The working fluid channel 13 is a channel for impingement of the working fluid 131 on the rotor blades of the rotor 12.

Furthermore a cavity 20 is present between the upstream stator component 111 and the downstream rotor component 121.

A least one heat shield 14 (ingestion shield) is located in the cavity 20 for protecting the stator ring 1111 from an erosive attack of the working fluid 131. The heat shield is a heat shield ring 141 with a circumference which is similar to the circumference of the stator ring 1111. Hot working fluid 131 can't directly attack the stator ring 1111. The heat shield ring 141 has the function of an ingestion shield.

The heat shield is advantageously made of sheet metal.

The heat shield 14 is a consumable. It is made out of a low grade alloy. In this specific embodiment the low grade alloy is X22CrMoV12-1.

The thickness of the heat shield 14 is about 2.0 mm.

The heat shield 14 is assembled between the stator ring 1111 and guide vanes 1112 (made of poly crystalline IN792) of the turbomachine. The heat shield 14 mechanically fixed between the stator ring 1111 and guide vanes 1112. The heat shield 14 is clamped by the stator ring 1111 and the guide vanes 1112. By this, the heat shield is axially locked.

In a first embodiment the heat shield ring 141 is a non segmented heat shield ring. The heat shield ring 141 is formed in one piece. Alternatively, the heat is shield ring 141 is a segmented ring or a split ring.

This turbomachine is used for producing electricity by leading the working fluid 131 to the rotor blades of the rotor 12 through the working fluid channel 13.

For the production of electricity the rotor 12 is coupled to a generator.

The invention claimed is:

1. A turbomachine comprising:

a stator comprising at least one stator component, with a guide vane component as a first one of the stator component and a stator ring as a second one of the stator component;

a rotor comprising at least one rotor component;

at least one working fluid channel for channeling a working fluid for driving the rotor, wherein the working fluid channel is bordered by the guide vane component and the rotor component, a cavity located downstream of the guide vane component and upstream of the rotor component in respect of the flow of the working fluid in the working fluid channel, at least one heat shield located in the cavity separating the cavity into a first cavity and a second cavity for reducing the working fluid ingress into the second cavity for protecting the stator ring and/or the rotor component from an erosive attack of the working fluid, wherein the heat shield comprises an annular ring section that is mechanically fixed to the stator and that is disposed in an annular channel located between the stator ring and the guide vane component, and wherein the heat shield comprises a consumable material of a lower grade than a material of the stator or of the rotor.

2. The turbomachine according to claim 1, wherein the working fluid is hot gas of a gas turbine or superheated steam of a steam turbine.

3. The turbomachine according to claim 1, wherein the consumable comprises a metal alloy.

4. The turbomachine according to claim 3, wherein the metal alloy is stainless steel.

5. The turbomachine according to claim 1, wherein the heat shield comprises a thickness which is selected from the range between 0.5 mm and 5.0 mm.

6. The turbomachine according to claim 1, wherein the heat shield comprises a heat shield ring.

7. The turbomachine according to claim 6, wherein the heat shield ring is a segmented ring or a split ring.

8. The turbomachine according to claim 1, wherein the heat shield is made of sheet metal.

9. The turbomachine according to claim 1, wherein the heat shield is made of high temperature resistant alloy.

10. The turbomachine according to claim 1, wherein the heat shield comprises a conical section.

11. The turbomachine according to claim 10, wherein the conical section being a dividing plate between the first cavity and a second cavity.

12. The turbomachine according to claim 1, wherein the heat shield comprises a thickness which is selected from the range between 1.0 mm and 3.0 mm.

13. The turbomachine according to claim 1, wherein the heat shield comprises a thickness which is selected from the range between 1.5 mm and 2.5 mm.

14. The turbomachine according to claim 1, wherein the heat shield comprises a cylindrical section beginning at an outer diameter of the annular ring section and extending downstream, and conical section extending radially outward and downstream from a downstream end of the cylindrical section.

15. The turbomachine according to claim 1, wherein the consumable material comprises a stainless steel.

16. A method for producing electricity or for rotating a further component, comprising:

operating a turbomachine comprising:

a stator comprising a guide vane component and a stator ring;

a rotor comprising at least one rotor component;

at least one working fluid channel for channeling a working fluid for driving the rotor, wherein the working fluid channel is bordered by the guide vane component and the rotor component, a cavity located downstream of the guide vane component and upstream of the rotor component in respect of the flow of the working fluid in the working fluid channel, at least one heat shield located in the cavity separating the cavity into a first cavity and a second cavity for reducing the working fluid ingress into the second cavity for protecting the stator ring and/or the rotor component from an erosive attack of the working fluid, wherein the heat shield comprises an annular ring section that is mechanically fixed to the stator and that is disposed in an annular channel located between the stator ring and the guide vane component, and wherein the heat shield comprises a consumable material of a lower grade than a material of the stator or of the rotor, and leading the working fluid to the at least one rotor component through the working fluid channel.

* * * * *